United States Patent [19]

Bell

[11] 3,999,600

[45] Dec. 28, 1976

[54] HEAT TRANSFER SHIELDS

[75] Inventor: Alan Bell, Cookham, England

[73] Assignee: Foster Wheeler Corporation, Livingston, N.J.

[22] Filed: Oct. 7, 1974

[21] Appl. No.: 512,770

[30] Foreign Application Priority Data

Oct. 24, 1973 United Kingdom ..... 49654/73

[52] U.S. Cl. ..... 165/78; 110/98 R; 165/134

[51] Int. Cl.[2] ..... F28F 19/00; F23M 9/10

[58] Field of Search ..... 110/98 R; 165/134, 78

[56] References Cited

UNITED STATES PATENTS

| | | | |
|---|---|---|---|
| 1,782,829 | 11/1930 | Nash et al. | 165/134 X |
| 2,902,264 | 9/1959 | Schick et al. | 165/134 |
| 3,078,919 | 2/1963 | Brown | 165/134 X |
| 3,149,667 | 9/1964 | Astrup | 165/134 |
| 3,368,532 | 2/1968 | Lewis et al. | 165/134 X |

FOREIGN PATENTS OR APPLICATIONS

| | | | |
|---|---|---|---|
| 220,636 | 9/1961 | Austria | 165/134 |

*Primary Examiner*—Albert W. Davis, Jr.
*Assistant Examiner*—Sheldon Richter
*Attorney, Agent, or Firm*—Marvin A. Naigur; John E. Wilson

[57] ABSTRACT

In horizontal tubes in which water evaporates steam tends to separate as an upper layer and, when such tubes are heated by hot gases passing downwardly over them, the upper regions which are in contact with steam and not water tend to overheat and be subject to corrosion. This is overcome according to the invention by covering the upper regions with shields, preferably of inverted V shape, which prevent the hot gases impinging on these regions. The tubes form part of a heat exchanger which can, for example, be an evaporator tube bank positioned in a convection pass in a steam boiler.

5 Claims, 2 Drawing Figures

HEAT TRANSFER SHIELDS

This invention relates to steam boilers, heat exchange tube banks and particularly tube banks in boilers where the banks have horizontal heat exchange lengths of tubes over which hot flue gases produced in a furnace pass downwardly to effect heat exchange between the hot gases and fluids such as water in the tubes.

BACKGROUND OF THE INVENTION

Steam boilers comprise a furnace in which fuel is burnt to produce hot gases and then these gases usually pass along a convection pass which contains one or more banks of substantially horizontal tubes. Where the hot gases pass downwardly through the convection pass and water is evaporating in the horizontal tubes, e.g. in an evaporated bank or steaming economiser tube bank, the steam produced separates and forms a blanket across the ceiling of the tube. In such situations it has been found that the downwardly moving hot gases impinge on the tubes in their upper regions where the blankets of steam have collected and those regions are particularly susceptible to excessive heating and internal corrosion.

An object of the invention is at least to reduce the magnitude of this problem.

THE INVENTION

According to the invention there is provided a heat exchanger comprising a bank of substantially horizontal tubes within which fluid is intended to be heated by heat exchange with hot gases passed downwardly over the tubes, one or more shields being provided above each tube to prevent downwardly flowing hot gases from impinging directly on the upper surfaces of each tube.

The invention also extends to a steam boiler having a furnace chamber in communication with a convection pass such that the hot combustion products are arranged to pass downwardly through it over one or more tube banks positioned witin that pass, at least one of the tube banks being a heat exchanger tube bank as defined above.

The invention has the advantage that because the hot gases do not impinge directly on the upper surfaces of the tubes heat transfer at the upper regions of the tubes where the blanket of steam may have collected is reduced and excessive heating and internal corrosion at those regions is reduced.

It has been found that corrosion on the internal surfaces of the tubes occurs over a region of the tube extending to 60° either side of a vertical line passing through the longitudinal axis of the tube. The shield should therefore be of such a size that the hot gases are prevented from impinging directly on that region of the tube.

A separate shield or shields may be provided for each horizontal length of tube and may be made from metal such as stainless steel or ceramic material depending upon the temperature which it has to withstand which may, for example, be as high as 1600° F.

The shield should be such that the hot gases are prevented from impinging directly on the upper part of the tube but should not prevent the hot gases flowing round the sides and base of the tubes where heat exchange can occur between the gases and the liquid fluid in the tube.

The shield may be curved or made from a number of flat members joined at their longitudinal edges. In an embodiment of the invention the shield comprises two flat members joined to one another along their longitudinal edges to form a shield which in cross-section is shaped like an inverted V. Preferably the two sections are at an obtuse angle to each other.

The tubes which are to be protected according to the invention may have associated fins and it has been found particularly convenient to rest the shield in slots in these fins. The slots can be arranged so that the shield can be slid along the fins from open end of the tube so that it is supported on all the fins associated with the tube.

The shield can be of any length and any number of shields can be slid into place over a horizontal length of tube to form a continuous shield.

If necessary the shields can be tack welded to one or more of the fins such as at the middle of the shields to hold them firmly in position.

The heat exchanger of the invention may also be employed as an evaporator or steaming economiser tube bank in a boiler.

BRIEF DESCRIPTION OF THE DRAWINGS

The invention will now be illustrated, by way of example, with reference to the accompanying drawings, in which.

DESCRIPTION OF THE PREFERRED EMBODIMENT

Figure 1:
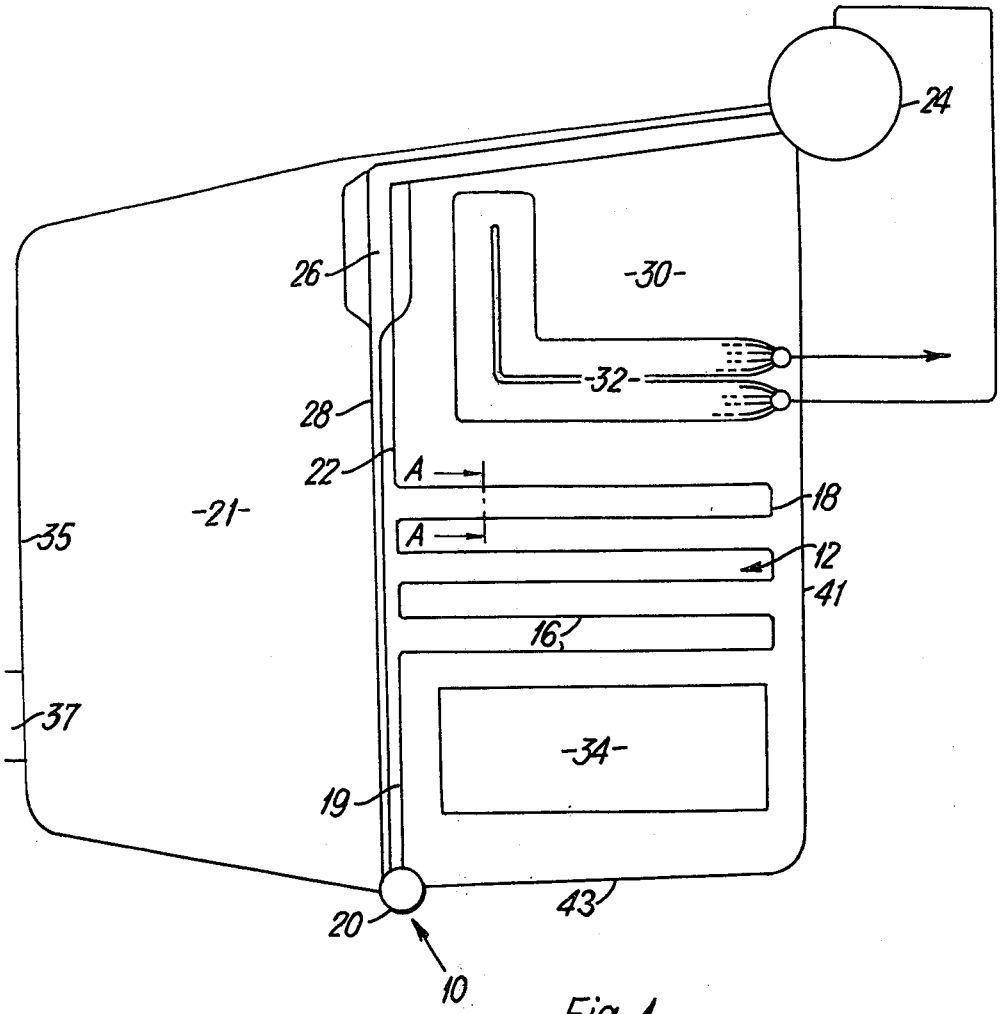
FIG. 1 diagrammatically shows a part of a water tube single drum steam boiler.

The water tube steam boiler 10 shown in FIG. 1 has a furnace chamber 21 and a convection duct 30. The furnace chamber is defined by water tube walls 35 (not shown in detail) and an intermediate upright water tube wall 28. The duct 30 is in turn defined by water tube walls 41 (again not shown in detail since they form no part of the present invention) and the wall 28. At its top the wall 28 has an opening 26 formed by bending adjacent tubes apart so that hot combustion gases produced by burning fuel in burners 37 in the furnace 21 of the boiler 10 pass through the opening 26 and down the duct 30 leaving through an outlet 43 at the lower end of the duct 30.

The various walls 35, 28 and 41 are cooled by the passage through them of water passing between a lower water header 20 and an upper steam and water drum 24.

Positioned in the duct in descending order are a bank 32 of superheating tubes, a bank 12 of evaporating tubes and a bank 34 of economising tubes, the hot gases passing downwardly over these banks.

The bank 12 is composed of a number of sinuous evaporating tubes which have horizontally disposed legs 16 connected by joins 18. The evaporating tubes are joined to the lower header 20 by tubes 19 and to the upper steam drum 24 by tubes 22.

Figure 2:
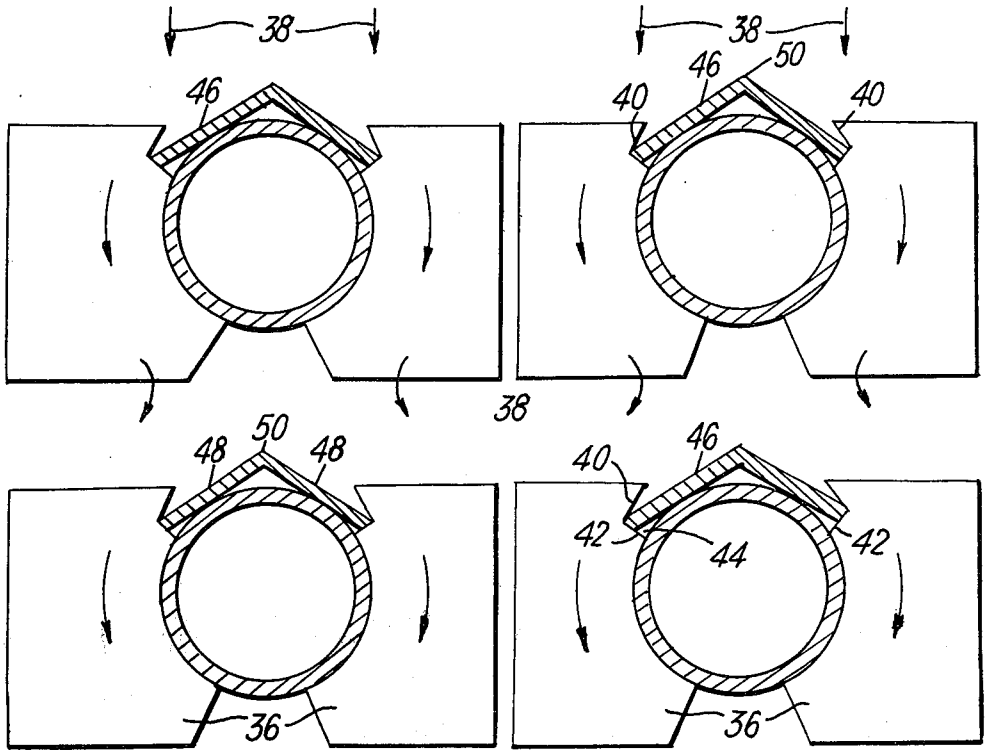
FIG. 2 is an enlarged sectional detail taken along the line A—A of FIG. 1.

As shown in FIG. 2, each of the horizontal lengths of tube 16 is attached to a plurality of evenly spaced opposed pairs of wing-shaped upright fins 36 which increase the surface area of the tubes to increase the heat exchange between the water and steam in the tubes and the hot gases flowing downwardly over the tubes, indicated by the arrows 38.

Some separation of the steam formed in the evaporating tubes occurs in the horizontally disposed legs 16 with the result that the upper parts of the tubes in these legs tend to contain steam. This is also the region of the tubes against which the hot gases impinge and as a result these regions are liable to overheating and excessive corrosion leading to risk of failure.

To mitigate this problem, each of the fins 36 is provided with a cut-out 40 which forms a shoulder 42 on which the lower edges 44 of a shield 46 rests. The shield 46 is composed of two flat sections 48 joined along their longitudinal edges 50 so that in cross-section it has the shape of an inverted V.

The shields can be slid into place above the horizontal lengths of tube 16 from one end of the bank and any number of shields can be placed end to end to form a continuous shield. The shields can be held in place, if necessary, by tack welds at, for example, the middle of the shields.

The shields provide a simple but effective solution to the problem of internal corrosion on the upper internal surfaces of the tubes where blankets of steam collect since they prevent the hot gases impinging directly on these upper surfaces, while not preventing good heat transfer to the rest of the tube surface.

Although the terms water and steam have been used herein they are to be construed as embracing references to any suitable liquid and its vapour unless the context specifically requires otherwise.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

What I claim is:

1. A steam boiler comprising:

a furnace;

a convection pass;

an inlet at the top of said convection pass for entry of hot combustion gases from said furnace and for passage down said pass;

at least one bank of tubes extending horizontally over most of their length and arranged to be heated by the passage of hot gases down said pass;

means for feeding water to said tubes;

a shield provided above each tube to prevent said hot gases passing down said pass from impinging directly on the upper surface of said tubes, each of said shields comprising two substantially elongated flat strips joined along adjacent edges so that said shield has in cross-section the form of an inverted V; and a plurality of fins attached to each of said tubes, each of said fins extending laterally of one of said tubes and having at its upper marginal edge portion a cut-out extending downwardly and outwardly from said one tube so that a shield can be moved longitudinally over the top of said one tube with the lower edges of said shield positioned within said cut-outs into position with said shield covering substantially all of said tube while contacting said tube on each of said strips, said shield being retained in position by said fins.

2. The steam boiler defined in claim 1 wherein said fins are positioned in pairs with one of each pair being on one side of said tube and engaging against said tube at a location below the top of said tube.

3. The steam boiler defined in claim 1 further comprising curved tubular sections connected between the ends of pairs of said tubes whereby said bank is formed of serpentine tubes.

4. The steam boiler defined in claim 1 wherein said strips are joined at an obtuse angle to one another.

5. The steam boiler defined in claim 1 wherein said strips are of a sufficient size to cover the upper surfaces of said tubes over an area extending about 60° on either side of the vertical passing through the tube axis.

* * * * *